US008440119B2

(12) United States Patent
Ackroyd et al.

(10) Patent No.: US 8,440,119 B2
(45) Date of Patent: May 14, 2013

(54) PROCESS OF MAKING A FABRIC

(75) Inventors: Dennis D. Ackroyd, Casco, ME (US); Francis Lai, Richmond (CA)

(73) Assignee: Tempnology LLC, Portsmouth, NH (US)

( * ) Notice: Subject to any disclaimer, the term of this patent is extended or adjusted under 35 U.S.C. 154(b) by 801 days.

(21) Appl. No.: 12/334,682

(22) Filed: Dec. 15, 2008

(65) Prior Publication Data

US 2009/0163099 A1 Jun. 25, 2009

Related U.S. Application Data

(60) Provisional application No. 61/014,973, filed on Dec. 19, 2007.

(51) Int. Cl.

| | |
|---|---|
| ***D03D 15/00*** | (2006.01) |
| ***D03D 23/00*** | (2006.01) |
| ***D04B 39/00*** | (2006.01) |
| ***D06C 23/00*** | (2006.01) |

(52) U.S. Cl.
USPC ..... 264/78; 264/103; 264/129; 264/232

(58) Field of Classification Search ..... 264/78, 264/103, 162, 232, 233, 129; 8/445, 494; 347/1, 347/105
See application file for complete search history.

(56) References Cited

U.S. PATENT DOCUMENTS

| | | | | |
|---|---|---|---|---|
| 3,317,367 | A | 5/1967 | Koller | |
| 4,465,730 | A * | 8/1984 | Okada | 442/243 |
| 5,065,600 | A | 11/1991 | Byles | |
| 5,217,782 | A * | 6/1993 | Moretz et al. | 428/91 |
| 5,306,536 | A | 4/1994 | Moretz et al. | |
| 5,735,145 | A | 4/1998 | Pernick | |
| 5,815,867 | A | 10/1998 | Keasler et al. | |
| 5,906,876 | A | 5/1999 | Conway | |
| 6,156,072 | A * | 12/2000 | Usui et al. | 8/445 X |
| 6,432,504 | B1 | 8/2002 | Yeh | |
| 6,918,140 | B1 | 7/2005 | Cooper | |

(Continued)

FOREIGN PATENT DOCUMENTS

| | | |
|---|---|---|
| EP | 1350872 | 10/2003 |
| EP | 1650335 | 4/2006 |
| WO | WO-2006000348 A1 * | 1/2006 |

OTHER PUBLICATIONS

Coolmax(R) fabric Brand Value, marketing pages from website coolmax.invista.com, date unknown, 4 pp.

(Continued)

*Primary Examiner* — Leo B Tentoni
(74) *Attorney, Agent, or Firm* — Verrill Dana, LLP; Chris A. Caseiro

(57) ABSTRACT

A fabric for thermal management including the cooling of an object, such as a person's skin. The fabric is formed of a plurality of materials including at least one liquid transport enhancing material and at least one evaporative transport impeding material. When the fabric is in use, the transport enhancing material is located near an object to be cooled, while the evaporation impeding material is spaced away from the object. The fabric is peached so that there is an entanglement of the two materials. Peaching is performed on both sides of the fabric, but initially on the side with the transport enhancing material such that a portion of the evaporation impeding material is pulled into the fabric core. A method of making the fabric is also described.

9 Claims, 5 Drawing Sheets

U.S. PATENT DOCUMENTS

| | | | | |
|---|---|---|---|---|
| 2005/0034330 | A1* | 2/2005 | Baychar | 36/55 |
| 2007/0141940 | A1 | 6/2007 | Baychar | |
| 2008/0096001 | A1 | 4/2008 | Emden et al. | |
| 2009/0191383 | A1* | 7/2009 | Kluge et al. | 8/445 X |

OTHER PUBLICATIONS

CoolPass(R) product disclosure, Jiangsu Hengli Chemical Fiber Co., Ltd., in English and Chinese, date unknown, 2 pp.

X-Static Fiber Yarn product disclosure, informational materials from website ftc.com.tw, date unknown, 2 pp.

Japan's polyester fiber: Shift to niche markets to avoid competition with China, Asian Textile Business, May 2003, 2 pp.

Clarke, Diana, The Sun and Your Skin, Health and Science Information on Life and Light, Interview with Kathryn Hatch, Ph.D on How Consumers can Select and care for Their Own Garments to Improve Their Sun Protection, from website www.yourskinandsun.com, Jun. 23, 2007, 4 pp.

Day, Marla, UPF Fashion! New Options to Keep UV Rays at Bay, Kansas State University Agricultural Experiment Station and Cooperative Extension Service, Aug. 2001, 4 pp.

Coolweave PTY, Activating Silver Eagle Cool Products, Aug. 29, 2007, 3 pp.

International Search Report and Written Opinion for corresponding PCT application No. PCT/US08/87155, Mar. 26, 2009, 8 pp.

* cited by examiner

PROCESS OF MAKING A FABRIC

CROSS REFERENCE TO RELATED APPLICATION

This application claims the priority benefit of U.S. provisional patent application Ser. No. 61/014,973, filed Dec. 19, 2007, entitled FABRIC AND METHOD OF MAKING THE SAME of the same named inventors. The entire content of the priority application is incorporated herein by reference.

BACKGROUND OF THE INVENTION

1. Field of the Invention

The present invention relates to a fabric and a method of making the fabric. More specifically, the present invention relates to a fabric that is made to regulate moisture dispersal therethrough to enhance its ability to provide evaporative cooling. Even more specifically, the present invention relates to a fabric that becomes cool when activated by liquid and remains cool for an extended period of time thereafter, and a method of making the same fabric.

2. Description of the Prior Art

Although everyone enjoys a warm sunny day, there are times when the outside temperature is too hot to be enjoyable. At such times, some people choose to remain in, or retreat to, their air-conditioned homes or offices to avoid or escape the heat. These solutions, however, are impractical to those who must remain outside, such as a highway worker, for example, and are unsatisfying to those who wish to remain outside, such as an athlete, a theme park patron or beachgoer, for example. Fabric performance will vary depending on climate, humidity, and air flow.

People have adopted a variety of approaches for cooling themselves outdoors. These efforts are largely ineffective and are not completely satisfying. For example, many people who are exposed to oppressive heat cool themselves by soaking one of the many existing fabric materials, such as a cotton facecloth or a towel, for example, in cold water and holding it against their skin. While this technique is effective, it is effective only for a very short period of time, perhaps one minute or so. The downfall of this technique is that the individual's body heat and the ambient temperature rapidly warm the initially cold water to the point that the water is no longer cooling against the skin. The most commonly employed "solution" to this problem, which is to repeatedly saturate the towel or facecloth in cold water as needed, is not satisfying because it requires much effort, and is not practical because it requires the individual to constantly be near a cold water source.

Other mechanisms employed by individuals to cool themselves include the application of ice, alcohol-dipped towels, and of relatively limited availability, cloths including phase change materials. The availability of ice in any given situation may be limited. Its formation can be costly and its ability to conform to most any area of the body is severely limited. Alcohol-dipped towels are not widely used, although they tend to be a focus of professional sports teams' cooling solutions. However, the alcohol is drying to the skin and can lead to rashes and other skin irritations. Phase change materials are chemicals that absorb and transfer heat through changes between solid and liquid state. The chemicals employed for that purpose can be hazardous and ineffective if their carriers are breached.

Presently, there is no effective non-chemical means of thermal regulating the rate of evaporation in a device that can be used to conform with a person's body, such as around the neck, for example. Evaporative cooling is the natural effect of moisture escaping into the atmosphere at will. The ability to regulate the rate of moisture dispersal and create one's personal cooling environment for an expanded period of time in a device, such as a fabric, is desirable.

A need therefore exists for a convenient, easy-to-use, flexible device, such as a fabric that remains cool for an extended period of time when held against an object and a method of making the fabric. A need also exists for moisture management that allows a user to establish a sustained thermal environment with minimal effort and no chemicals.

SUMMARY OF THE INVENTION

It is an object of the present invention to provide a convenient, easy-to-use, flexible fabric that remains cool for an extended period of time when contacted against an object to be cooled, such as a person's skin or an inanimate object for which temperature maintenance is desirable, and a method of making the fabric. It is also an object of the present invention to provide a moisture management fabric that can assist in maintaining a sustained thermal condition of an object for an extended period of time with minimal effort and no temperature-regulating chemicals in the fabric. Further, it is an object of the present invention to provide a method of manufacturing such a fabric with such characteristics.

The fabric of the present invention is formed by weaving or knitting a plurality of yarns. The composition of the fabric may be varied in that it may be formed of a plurality of materials. The materials are selected to provide certain characteristics through the fabric. The portion of the fabric to be positioned adjacent to the object to be cooled (or maintained at a defined thermal condition), that is, the back side of the fabric, is configured to transfer liquid away from the object. The interior of the fabric is configured to store, or otherwise retain in some manner, the liquid, and the portion of the fabric on the side away from the object, that is, the front side of the fabric, is configured to cause the transfer of liquid out of the fabric to occur at a rate that is slower than the rate at which the liquid transfers away from the object. For example, the back side is or includes a hydrophobic fiber material, the interior includes an intermediary material and/or configuration that stores, and the front side is or includes a hydrophilic fiber material. In an embodiment of the invention, the back side material may be polyester, the intermediate portion of the fabric may include a hollow fiber material, and the front side material may be nylon or combined with polyester to form a homogeneous blend. Other materials used to make the yarns of the fabric may be employed. When the intermediate portion includes a hollow fiber, such as a hollow polyester fiber, the liquid is wicked within the conduit established by each individual fiber to facilitate transport between the two fabric sides while also providing the capability to store the liquid therein. Further, supplemental materials may be incorporated into the fabric for supplemental purposes. For example, anti-static, anti-microbial and/or anti-odor additive materials may be used. One example of such an additive is a silver thread suitable for its anti-microbial functionality.

After the fabric is formed by weaving or knitting, the fabric optionally may undergo one or more treatments, such as scouring and bleaching treatments, for example. These treatments may be performed, for example, for the purpose of preparing the fabric for dyeing and/or for printing one or more designs onto the fabric.

After undergoing any optional treatments, including scouring, bleaching, dyeing and/or printing, for example, the fabric is brushed or peached to break some of the yarns and may be sheared to adjust the pile height of the yarns to a selectable value. For purposes of the description of the present invention, the process of making the fabric will be described as including the step of peaching, which word will be used to refer to brushing or peaching as understood by those of ordinary skill in the art. The fabric is mechanically modified, such as by peaching, in a manner that results in fibers on the front side of the fabric being pulled toward the back of the fabric. This is achieved, for example, by peaching the fabric on its back side prior to performing any peaching on its front side.

Present manufacturing processes that include a peaching step perform the peaching on the front side only, or at least do so first, thereby minimizing the ability to pull fibers on the front side toward the back side of the fabric. Instead, the peaching on the front side is done to create texture, pile and/or "hand" on the front side of the fabric, such as to enhance the insulative characteristics of the fabric with little or no regard for the condition of the back side or establishing a cooling functionality.

The peaching step of the manufacturing method of the present invention involves peaching both the front and back sides of the fabric multiple times each to create a homogeneous blend of the different materials. That is, at least portions of the fiber material of the front side and the fiber material of the back side become entangled with one another. These homogeneous blends of materials having dissimilar characteristics maintain an atmosphere that is conducive to maximizing the uniqueness of the individual fiber properties and thus control/regulate the rate of evaporation.

The fabric of the present invention is configured to facilitate liquid removal from the surface of the object, store liquid therein, and slow the evaporation of liquid away from the fabric to the atmosphere. Any type of prior commercially available fabric designed to cool is limited to causing rapid transport of liquid away from the skin and equally rapid transport of that liquid completely out of the fabric. In other words, prior cooling fabrics using no chemicals to induce cooling artificially, are configured to get liquid away from the skin as soon as possible and nothing more. This may achieve short term cooling, but fails to enable longer term cooling, particularly for individuals who are not exercising (and thereby generating their own moisture to produce evaporative cooling). The fabric of the present invention utilizes the cooling effect available from retained liquid. By withdrawing that liquid, at what is likely to be its highest temperature at the surface of the object, from the surface, storing the liquid within the fabric so that it cools down to become a more effective evaporative agent than it was when at a higher temperature, and restricting the ability of that cooled liquid to quickly evaporate from the atmosphere-side of the fabric, ensures a substantially longer cooling capability than has been made available.

The present invention is directed to creating in a fabric a controlled environment that maximizes wicking where desired and retention of liquid molecules within the fabric structure. The invention utilizes yarns/fibers organized in the manner described herein to maximize fabric traits that interfere with the normal process of evaporation away from the fabric. These traits include diverting liquid from the surfaces of individual fibers near the object to the interior of the fabric, trapping the liquid at the interior, and, ultimately, slowing the rate of evaporation from the fabric. As used herein, "evaporation" means the change of a liquid into a vapor at a temperature below the boiling point of that liquid; a condition that exists at the surface of the liquid, where molecules with the highest kinetic energy are able to escape, when this happens, the average kinetic energy of the liquid is lowered, and its temperature decreases. With that in mind, the present invention is configured to facilitate evaporation within the fabric as much as possible to aid in the cooling of the object while also slowing evaporation of liquid from the fabric itself. Fiber characteristics, density and arrangement all have a hand in regulating evaporation rate. The present invention involves fiber selection, positioning and physical modification to achieve desired evaporation control. For example, the intermediary portion of the fabric includes a network of interstices or capillaries the configuration of which is defined by the fiber shape and the arrangement of fibers with respect to one another. That network slows the progression of liquid completely out of the fabric and allows for evaporative cooling of the liquid that facilitates heat transfer from the object to be cooled.

When in its finished form, the fabric of the present invention may be used for any one or more of a large variety of purposes and to partially or wholly form any one or more of a large variety of products, including, but not limited to, those purposes and products that are later described herein.

The cooling properties of the fabric of the present invention, which may include maintaining an object at a selected temperature for a period of time, makes it amenable to being used in a large variety of applications. For example, the fabric may be used to wholly or partially form a plurality of apparel and personal products that can be worn or otherwise used by a person in the hot sun or while exercising to keep cool. As another example, the fabric may be used to wholly or partially form a plurality of skin-associated medical health products that can be used to keep a patient cool. The fabric of the present invention satisfies this need because it becomes cool at its interface with the patient's skin by wicking away any "warm" liquid (e.g., perspiration), storing that liquid in the intermediary portion such that it begins to cool by slowing its progression through to the other surface of the fabric and enabling the retained relatively cooler liquid to provide further cooling of the skin. The fabric may also be used to keep inanimate objects cooled, such as materials to be transported, for example. The fabric created through the combination of materials and manufacturing steps described provides maximum wicking and absorption where needed near the object, and moisture storage characteristics that allow for evaporative cooling within the fabric and reducing the rate of normal liquid evaporation away from the fabric.

These and other features and advantages of the invention will be apparent upon review of the following detailed description, the accompanying drawings and the appended claims.

DETAILED DESCRIPTION OF THE PREFERRED EMBODIMENTS OF THE INVENTION

Figure 1:
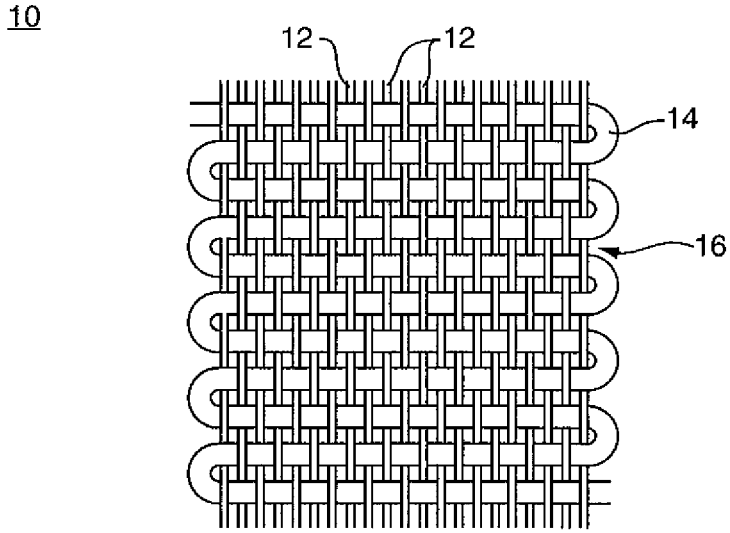
FIG. 1 is a close-up view of a fabric of the present invention showing a general form of the fabric as including a plurality of warp yarns and a single weft yarn.

The present invention is a fabric that may be single-ply or multi-ply. The present fabric: (1) cools when exposed to a liquid, such as perspiration from an individual's body, for example; (2) is able to wick (transport) perspiration, water or other liquid from an object such as an individual's skin; (3) is able to absorb a liquid at a weight that is a plurality of the weight of the fabric; (4) efficiently regulates the evaporation rate and retains a liquid with minimal loss of the liquid over an extended period of time; (5) controls moisture release, that is, it provides moisture management; and (6) is reusable, while retaining all of these characteristics from use-to-use. The present invention also is a method of making the fabric having these characteristics.

The side of the fabric to be positioned adjacent to the object to be cooled, referred to herein as the back side, is configured to enhance the transfer of liquid away from the object, such as by wicking, while the other side of the fabric that is spaced away from the object is configured to slow evaporation The back side may be relatively more porous than the front side as a mechanism to facilitate liquid transfer. Further, its wicking characteristics may be optimized, such as by using fibers made of hydrophobic material and/or with large peripheral surface area. On the other hand, the front side may be relatively less porous than the back side as a mechanism to slow liquid evaporation (by trapping the liquid, or at least slowing its progression to the outer surface of the fabric). Further, its wicking characteristics may be minimized, such as by using fibers made of absorptive or at least relatively hydrophilic material and/or with reduced peripheral surface area. An intermediate section of the fabric is configured to store liquid therein to allow liquid arriving from the back side to cool and slowing its passage out of the fabric through the front side.

The selected materials and material configurations for the back side and the front side, when peached as described herein, act in concert to enhance the movement/transportation of liquid from the surface of the object to the core of the fabric's construction. Cooled liquid either moves back toward the object or dwells long enough within the fabric to establish a sufficient heat gradient to effectively draw heat away from the object surface. This results in moisture movement in a controlled manner that enhances and extends the ability of the fabric to transfer heat between the object and the interior of the fabric. In effect, warm liquid adjacent to the surface of the object is drawn away from the object surface at the back side of the fabric and moved to the front side, while cooled liquid within the fabric is sufficiently close to the object at the back side to effect cooling. The regulated slower evaporation of the liquid from the fabric at the front side provides the extension of time for the cooled liquid within the fabric to act as a heat sink for the object.

While some manner of making a fabric creates interstices that act as fluid pathways, the combination of the material selection and peaching of the fabric as described herein makes that pathway characteristic much more substantial, creating a capillary web system that stores and orients the moisture molecules and holds them in suspension until such time as the fabric is activated; thus setting the molecules in motion and causing a disorientation of the moisture molecules so that they are inclined to move toward or away from an object to be cooled or maintained at a temperature. This recycling of moisture to and from the fabric core creates a regulated, controlled, extended evaporative cooling device.

As shown in FIG. 1, a fabric 10 of the present invention, which is shown in single-ply form, includes a plurality of warp yarns 12 through which at least one weft yarn 14 is woven or knitted. It is to be understood that the weft yarn 14 may be a single, integral yarn or it may be a plurality of yarns. When the weft yarn 14 is a plurality of yarns, the plurality of yarns may be fastened together, such as by tying, for example, or they may be separately woven or knitted through the warps yarns 12. When formed by the warp and weft yarns 12/14, the fabric 10 has a front side 16 and a back side 17 (not shown in FIG. 1), which is opposite the front side 16.

The warp and weft yarns 12/14 include a plurality of fibers. (Hereinafter, whenever the term "yarn" is not referred to specifically as either a "warp yarn" or a "weft yarn", it is to be understood that "yarn" is to include both a "warp yarn" and a "weft yarn".) The fibers of the yarns 12/14 may be formed from any one or more of a variety of materials including, but not limited to, polyester, and nylon, for example, with the nylon at the front side 16 and the polyester at the back side. The product CoolMax® available from E. I. DuPont de Nemours and Company of Wilmington, Del., or the product CoolPass® available from Jiangsu Hengli of Jiangsu, China, may be suitable choices for the polyester material of the back side. Any nylon is suitable for the front side 16 material and may be obtained from a wide range of sources, as is know by those of ordinary skill in the art. Additionally, the fabric 10 may include a hollow polyester fiber as an intermediate material to enhance fluid transport through the fabric 10 and storage of liquid within the fabric 10 for a period of time sufficient to allow evaporative cooling of the liquid while the front side 16 material reduces evaporative loss of the liquid. Further, additive materials may be incorporated into the fabrication of the fabric 10. Such additives may be selected for the purpose of eliminating odor, microbe formation or existence, static or other undesirable characteristics. One example of such an additive is a silver fiber suitable for anti-microbial protection. The silver-coated fiber X-Static® available from Noble Materials of Scranton, Pa., is an example of a suitable silver fiber additive.

In one embodiment of the present invention, the fabric 10 may be about 65% to about 85% polyester and about 15% to about 35% nylon. In another embodiment, the fabric 10 may be about 80% polyester and about 20% nylon. In yet another embodiment, the fabric 10 may be about 77% polyester and about 23% nylon. The actual fiber type choice and their percentage of use are dependent on the desired function of the fabric 10.

The relative thickness and fiber count of the yarns 12/14 is variable. Exemplary warp yarns 12 include warp yarns 12 ranging between about 50 denier and about 100 denier. For example, the warp yarn 12 may be about 75 denier. (The finer the denier, the greater the ability to create loft or pockets in which moisture can be held.) It is to be understood, however, that the weft yarn 12 is not limited to having these characteristics.

Exemplary weft yarns 14 include weft yarns 14 ranging between about 125 and about 175 denier and having a fiber count ranging between about 50 to about 175. For example, the weft yarn 14 may be about 160 denier and have a fiber count of about 70 or about 72. As another example, the weft yarn 14 may be about 160 denier and have a fiber count of about 144. It is to be understood, however, that the warp yarn 14 is not limited to having these characteristics.

Further, the yarns 12/14 may be of any one of a variety of textures and luster. For example, the yarns 12/14 may be, but are not limited to being, draw textured yarn (DTY), bright, semi-bright and semi-dull hollow (SDH).

Figure 2:
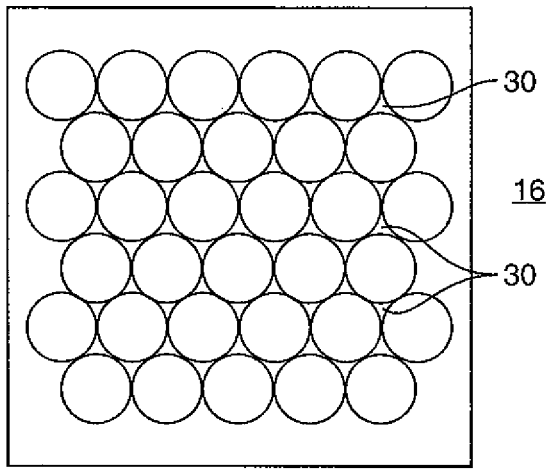
FIG. 2 is a cross sectional plan view of a simplified representation of the front side of the fabric.
Figure 3:
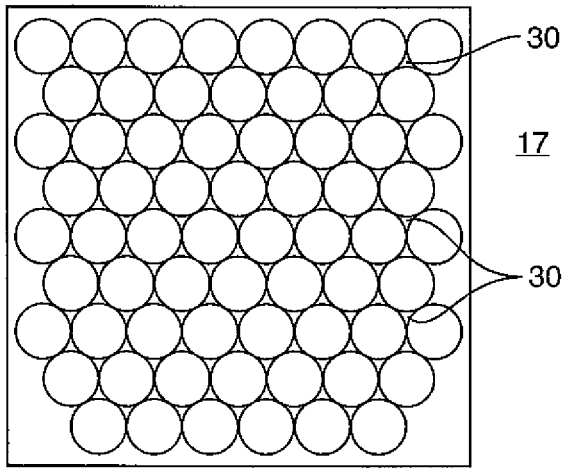
FIG. 3 is a cross sectional plan view of a simplified representation of the back side of the fabric.

As illustrated in FIG. 2, the fibers used to form the front side 16 of the fabric 10 are preferably relatively larger than the fibers used to form the back side 17 of the fabric 10 shown in FIG. 3. Specifically, the larger fibers of the front side 16 have fewer interstices 30 through which liquid can escape from within the interior of the fabric 10. On the other hand, the smaller fibers of the back side 17 have more interstices 31 through which liquid may pass relatively more quickly than is the possibility with the relatively smaller number of interstices of the front side 16. In addition, the smaller denier of the fibers of the back side 17 have more perimeter surface area for wicking to occur. Further, using a hydrophobic material on the back side 17 is more likely to repel liquid and therefore speeds liquid wicking into the interior of the fabric 10, while using a hydrophilic material on the front side 16 is more likely to absorb liquid and therefore slows liquid wicking through and out of the fabric 10. It is to be understood that either side of the fabric 10 may include a single fiber size or a plurality of fiber sizes. For example, varied thermal control may be established for the fabric 10 from one portion thereof to another by selecting different fiber materials and/or fiber sizes for the front side 16 and the back side 17.

Figure 4:
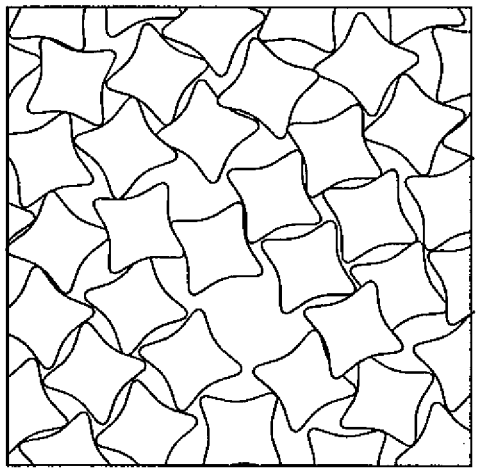
FIG. 4 is a cross sectional elevation view of a plurality of fiber materials having increased surface area for enhanced wicking.

Liquid wicking may be further enhanced by increasing the perimeter surface area of those fibers where enhanced wicking is desired. For example, the fibers of the back side 17, in addition to being smaller than the fibers of the front side 16, and/or hydrophilic rather than hydrophobic, may be shaped fibers having non-uniform cross sectional area. For example, FIG. 4 illustrates a fiber shape that is not uniformly round. The perimeter surface area of each such fiber is greater than the corresponding fiber of uniform shape and similar cross sectional area. An embodiment of the present invention includes making the back side 17 of the fabric 10 with such non-uniform fibers.

Figure 5:
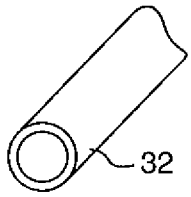
FIG. 5 is a cross sectional view of a first embodiment of a hollow fiber material for enhanced liquid transport and storage.
Figure 6:
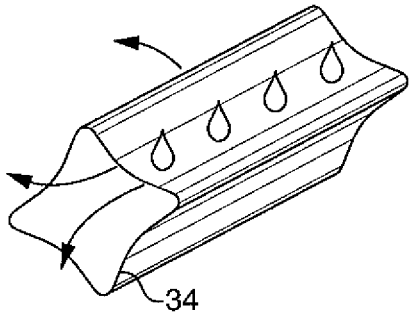
FIG. 6 is a cross sectional view of a second embodiment of a hollow fiber material for enhanced liquid wicking, transport and storage.

The fabric 10 of the present invention may also a material that is configured to maximize liquid transport and storage. As illustrated in FIG. 5, a first embodiment of a hollow fiber 32 may be employed as an intermediate material of the intermediate section of the fabric 10, wherein one or more such fibers are positioned between the front side 16 and the back side 17 of the fabric 10. The hollow fiber 32 is shown having a uniform cross sectional area. It is preferably made of a hydrophilic material so that it slows wicking, at least relative to a hydrophobic material. The interior of the hollow fiber 32 acts as a container for liquid passing therein. In an alternative embodiment of FIG. 6, second hollow fiber 34 is of non-uniform cross sectional area. Its increased perimeter surface area and hollow interior maximizes liquid retention within the fabric 10. This ability to allow liquid that is relatively warmer near the back side 17 to dwell within the fabric intermediate section ensures cooling of the liquid will occur to a point sufficient to permit that retained liquid to act as a heat sink as it approaches the front side 16 of the fabric 10. The second hollow fiber 34 is preferably made of a hydrophilic material so that it slows wicking, at least relative to a hydrophobic material.

Figure 7:
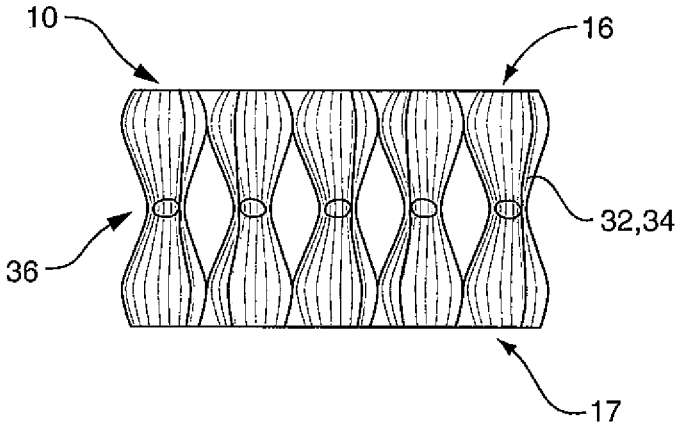
FIG. 7 is a cross sectional view elevation view of an embodiment of the fabric of the present invention, showing an intermediary fiber material between the back side and front side of the fabric.

As illustrated in FIG. 7, a plurality of intermediate section materials, such as a plurality of the hollow fiber 32 and/or the second hollow fiber 34, may be used with the fiber materials of the front side 16 and the back side 17. The combination of components identified enable the fabric 10 to speed at the back side 17 liquid wicking from the surface of the object, allow that liquid to dwell within the fabric intermediate section 36, and cause its evaporation completely from the fabric 10 to be delayed at the front side 16.

Figure 8:
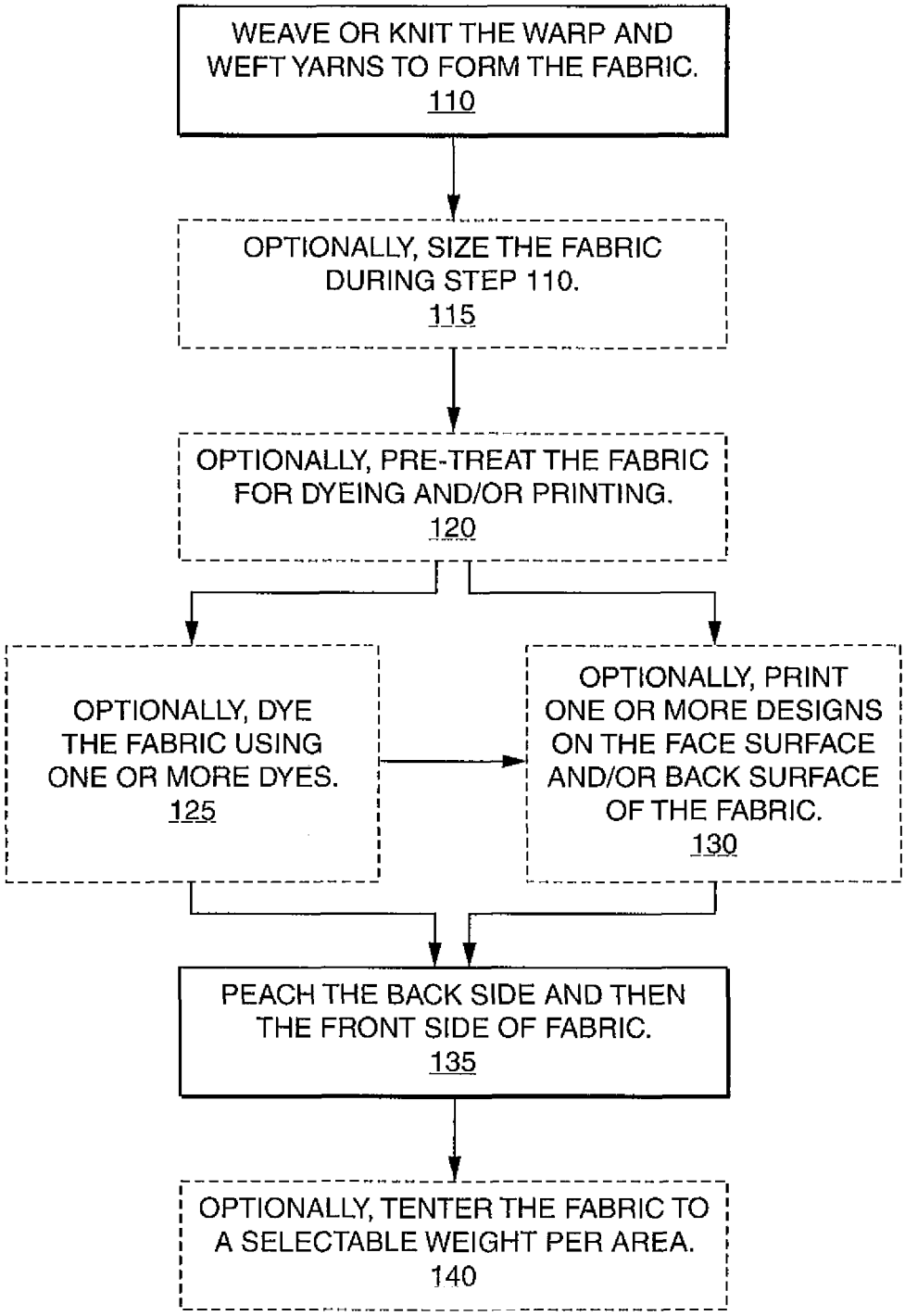
FIG. 8 is a flow diagram showing the general steps, some of which are optional, that may be taken to carry out a method of the present invention.

The method of the present invention includes a plurality of steps, several of which are optional. Generally, the steps of the method 100 may be carried out as shown in FIG. 8. In step 110, the fabric 10 is formed by weaving or knitting the yarns 12/14 together. For purposes of the description of the present invention, the two terms may be used interchangeably, such that when it is stated that the method 100 includes a weaving step, that means weaving or knitting the yarns together. In optional step 115, the fabric 10 may be sized simultaneously with the step 110. In optional step 120, the fabric 10 may be pre-treated as described herein to prepare it for subsequent dyeing and/or printing, for example, or for any other purpose. In optional step 125, the fabric 10 may be dyed any color using any one dye or combination of dyes. In optional step 130, one or more designs may be printed onto either or both of the face side 16 and the back side of the fabric 10. Because each one of steps 125 and 130 are optional, the fabric 10 therefore may be dyed but not printed, printed but not dyed, both dyed and printed, or neither dyed nor printed. In step 135, the fabric 10 is peached and sheared, and in optional step 140, the fabric 10 is tentered until the fabric 10 has a desirable weight per area value. (The weight per area of the fabric 10 therefore is selectable.)

The skilled artisan will recognize that the yarns 12/14 may be woven or knitted to form the fabric 10 by using any one or more of a variety of techniques that are well known in the art. For example, the skilled artisan will recognize that such weaving may be carried by using an air jet frame, and that such knitting may be carried out by using a 28-gauge double loop circular frame. Certainly not restricted or limited to these exact type of machines. Extensive research and development would be required to duplicate the physical construction to produce the same results on varied equipment but can be accomplished.

The fabric 10 optionally may be sized, such as for the purpose of increasing the strength of the yarns, for example. Sizing may be carried out, for example, by adding one or more sizing agents, preferably water-soluble sizing agents, during the weaving/knitting process.

The fabric 10 also is optionally dyeable and/or printable (that is, one or more designs may be printed onto the fabric 10). When the fabric 10 is to be dyed and/or printed, the fabric 10 may be pre-treated before the dyeing and/or printing of the fabric 10. For example, prior to dyeing and/or printing, the fabric 10 optionally may be subjected to one or more treatments, such as scouring and bleaching treatments, for example. Further, when the fabric 10 has been sized, the fabric 10 may be desized at this time. Desizing may be carried out, for example, simply by immersing the fabric in hot water.

Scouring may be carried out for the purpose of removing impurities, such as wax, oil, and dirt, for example, from the fabric 10. Scouring may be achieved by treating the fabric 10 with a scouring agent while the fabric 10 is being subjected to pressure and heat, the temperature of which is selected based upon the fibers selected to make the fabric. For example, if no hollow fibers are employed, or if fiber hollowness is not of sufficient importance, the heating may be at about 350° F., for example. The scouring agent may be a sodium hydroxide solution, for example. Further, the scouring agent may be a commercially available polymeric soil release agent, such as any one of the products of the Zelcon® line of products made available by E. I. DuPont de Nemours and Company of Wilmington, Del., and Milease T, which is made available by Imperial Chemical Industries, PLC of London, England, for example.

The fabric 10 also may be optionally bleached for the purpose of whitening the fabric 10. Generally, bleaching may be carried out, for example, by treating the fabric 10 with a bleaching agent, incubating the fabric 10 at an elevated temperature for an extended period of time, and washing and drying the fabric 10. Suitable bleaching agents include, but are not limited to being, solutions containing sodium hypochlorite, sodium chlorite and/or hydrogen peroxide, for example. Where the chosen bleaching agent is an alkaline solution, such as a hydrogen peroxide solution, for example, the bleaching may be carried out concomitantly with the scouring treatment.

It is to be understood that the fabric 10 may be pre-treated, such as being desized, scoured, or bleached, even when the fabric 10 is not to be later dyed and/or printed. For example, the fabric 10 may be bleached, but not dyed and/or printed, when the fabric 10 is to be white in its final form. As another example, the fabric 10 may be scoured, but not dyed or printed, when the fabric 10 is to retain its natural color in its final form.

After the fabric 10 has been pre-treated, if at all, dyeing of the fabric 10 may be achieved, for example, by using one or more disperse dyes of any color or combinations of color in a pressure and continuous dyeing process. Dyeing by using disperse dyes may include subjecting the fabric 10 to the dye or dyes while the fabric 10 is being exposed to elevated heat and high pressure, again, dependent upon the materials used to make the fabric 10. Under such conditions, the dye or dyes are able to penetrate the yarns 12/14 of the fabric 10, effectively dyeing the fabric 10.

Further, after the fabric 10 has been pre-treated and/or dyed, if at all, one or more designs optionally may be printed onto the fabric 10. It may be desirable to print a design or designs on the fabric 10 for a variety of reasons. For example, when a theme park is to distribute a product including the fabric 10, the theme park may wish to have a cartoon character or its logo printed onto the fabric 10 to help promote its brand. In this example, it is likely that the printed design would be fanciful and include a plurality of colors. As another example, when a hospital is to own a medical product that includes the fabric 10, the hospital may wish to its name printed onto the product for the purpose of helping to prevent the product from being removed from the hospital. In this example, it may be true that the printed design would be simple and include only a single color (e.g., the hospital's name may appear in black letters of a standard font).

Therefore, designs may be printed onto the fabric 10 by using one or more dyes or pigments. Further, the designs may be printed onto to the fabric 10 by using various methods and devices known to the skilled artisan. For example, the printing may be achieved by rotary screen printing, wherein the fabric 10 passes under a series of cylindrical screens, with each screen printing a different color onto the fabric 10.

Regardless of whether the fabric 10 is dyed and/or printed, the fabric 10 is peached and may then be sheared. Prior to peaching, moisture may be extracted from the fabric 10 by any one of a variety of techniques that are well known to the skilled artisan. This extraction may be achieved, for example, by centrifugation. The fabric 10 also may be dried by using a continuous hot oil drum, for example.

The skilled artisan will recognize that peaching may be achieved by carrying out any one or more of a variety of techniques and by using any one or more of a variety of devices. For example, peaching may be achieved by using a sanding machine that includes a series of circular pads that rotate in different directions to break the yarn 12/14 fibers. Further, as an alternative to this peaching process, the fabric 10 may be brushed by using a series of tubes having wire bristles that rotate in a circular motion around a circular cylinder. In this arrangement, the bristles contact the face 16 and/or back of the fabric 10, thereby breaking some fibers in doing so. Preferably, the fabric back is peached before the front side 16 is peached, and some of the yarns of the front side 16 are pulled through to the fabric back as a result of the peaching process to form a homogeneous blend of the different fiber materials. The final weight of the fabric is ultimately determined by creating the correct face to back pile ratio.

The skilled artisan will further recognize that shearing may be achieved by carrying out any one or more of a variety of techniques using any one or more of a variety of devices. Shearing may be achieved, for example, by using a machine that features a single cylinder rotation over a honed blade. In this arrangement, the blade is able to cut the previously peached front side 16 and/or back to a desired pile height. The pile height of the front side 16 or back may be selected, for example, to maximize or otherwise determine the moisture absorption ability of the fabric 10 by creating pile density or volume. While very specific exemplary pile heights are described in the Example section included herein, it is to be understood that the present invention is not limited to those values. In fact, the skilled artisan will recognize that a large plurality of pile height values is achievable.

The fabric 10 also may be tentered, such as to adjust the weight per area of the fabric 10 to a particular, selectable value, for example, by using any one or more of the tentering techniques that are well known to the skilled artisan. In one exemplary tentering technique, the fabric 10 is applied to a machine having a tenter frame of open width. (The "tenter frame" is a set of rails that run parallel to the floor on which the machine sets.) Located on these rails are sets of needles that grip the fabric 10 to hold it in place on the machine. The width of the frame may be varied as the fabric 10 moves through the machine, and when the fabric 10 reaches the desired width, live steam is injected into the fabric 10 to create memory in the fabric. ("Memory" is the phenomenon by which the fabric returns to its machined size whenever it is stretched, such as by human hand, for example.) While very specific exemplary weight per area values of the fabric 10 are described herein, it is to be understood that the present invention is not limited to those values. In fact, the skilled artisan will recognize that a large plurality of weight per area values is achievable. Final printing may then be performed on the fabric 10.

The skilled artisan will recognize that the fabric 10 of the present invention may be used for any one or more of a large variety of purposes and to partially or wholly form any one or more of a large variety of products. For example, the fabric 10 may be used to partially or wholly form apparel or non-apparel products such as towels, facecloths, shirts, pants, jackets, shorts, vests, ties, footwear, gloves, bandannas, hats, handkerchiefs, underwear, hosiery, bras, and bandages. Further, these products may be designed for recreational, exercise, medical, and military use, for example. For example, the fabric 10 may be used to form a towel that is to be sold or otherwise distributed to individuals who will be exposed to hot temperatures for a long period of time, such as patrons of an outdoor theme park, beachgoers, or athletes, for example. As another example, the fabric 10 may wholly or partially form a compress that may be wetted and placed on the forehead of an individual having an elevated body temperature for the purpose of keeping the individual cool. Regardless of how and for what reason the fabric 10 is to be used, however, the fabric 10 is especially useful for being included to wholly or partially form a product that is meant to provide instant and extended cooling to its user.

Once manufactured, the fabric 10 may be used by performing the following steps. The fabric 10 is initialed immersed in a liquid, such as water and soaking the fabric in the liquid. The liquid may be at any of a variety of temperatures for the immersion step. Next, any excess liquid on the surface of the fabric 10 or located within its interstices, may be wrung out, such as by twisting the fabric 10 (which is flexible), to force the excess liquid from the fabric 10. Next, the wrung out fabric 10 may be "snapped" to trigger activation of the thermal control capability of the fabric 10. For the purpose of the description of the present invention, snapping means any mechanical procedure by which the wetted fabric 10 is quickly moved from one position to another. For example, a person may snap the fabric 10 by holding it in two hands at its perimeter and rapidly moving upward and downward in one or more cycles. Alternatively, the snapping may be achieved by other means, such as with a mechanical device, for example.

The formation of the fabric 10 with a combination of the plurality of materials described herein configured in relation to one another as indicated results in the creation of a plurality of high-density capillary networks within the fabric 10. Liquid molecules are absorbed deep into the core of the fabric 10 and hydraulically compressed into the capillary networks of the fabric 10, such as through the activation process described above. The water molecules are oriented within the capillary networks by the activation step to enable maximum evaporative cooling to occur through the fabric 10. Additionally, the configuration of the fabric materials through the peaching process, as well as the characteristics of the materials, suppresses the otherwise natural occurrence of evaporative liquid loss that can occur with conventional fabric designs. In effect, the fabric 10 of the present invention traps the liquid into a cycle of evaporative cooling adjacent to the object to be cooled, trapping of evaporative liquid moving away from the object into the fabric interstices until, as the evaporated liquid approaches the opposing hydrophilic side of the fabric, it cools and returns to the object. This repetitive cooling cycle is achieved by the construction of the fabric 10 and allows the user to use water as the liquid employed for the evaporative cooling. The fabric 10 thereby eliminates the need to use chemicals such as alcohol and/or PCMs as an artificial cooling agent.

The fabric 10 and the method of the present invention are more specifically described with reference to a specific Example; however, they are not to be construed as being limited thereto. The fabric 10 of this Example exhibited cooling characteristics while maintaining structural integrity.

EXAMPLE

Fabric formation. A fabric of the invention having about 77% polyester and about 23% nylon was made in this Example. The warp yarn included as part of the fabric was DTY and SDH and had a relative thickness of about 75 deniers. The weft yarn included as part of the fabric was DTY and had a relative thickness of about 160 deniers per 144 fibers.

Prior to being woven, the yarns were added to an air jet weaving loom (having a width of 10,612 ends) at a density of a thread count of about 160 threads her square inch. The yarns were then woven to form the fabric according to standard protocols that are well known to those of ordinary skill in the art.

Printing pre-treatment. After being woven, the fabric was scoured by using Zelcon to remove any dirt, wax, oil, or other contaminants that may have been present.

Fabric Printing. After scouring, a plurality of multi-colored designs was printed onto the face of the fabric by using a sublimation printer according to protocols that are well known to those of ordinary skill in the art. Suitable printers for achieving such printing are available from, for example, the Roland DGA Corporation of Irvine, Calif., and Mimaki USA, Inc. of Suwanee, Ga.

After the printing process was complete, more than 90% of the moisture absorbed by the fabric was extracted from it by centrifuging the fabric for about 12 minutes. The fabric was then dried at about 400° F. while in a gas continuous hot oil drum and rolled into tubular form via an "a-frame" windup folding machine. The fabric back was peached and sheared to about 0.0939 inches (about 0.2385 cm). After the fabric back was peached, the fabric face was peached and then sheared to about 0.0313 inches (about 0.0795 cm). Specifics here are based on a desired finished weight based on a specific end use that requires a variation in weight for its intended performance level. This final weight is in direct proportion to the variation of the yarn (face/back/fill) of the yarn denier and the final finish.

Following peaching and then shearing, the fabric was tentered at about 380° F. The weight of the fabric after tentering was about 208 g/m$^2$.

The present invention has been described with respect to various examples. Nevertheless, it is to be understood that various modifications may be made without departing from the spirit and scope of the invention as described by the following claims.

What is claimed is:

1. A method of making a fabric having a front side, a back side and an interior between the front side and the back side, wherein the front side of the fabric is the side adjacent to the environment when the fabric is in use and the back side is the side adjacent to an object to be cooled when the fabric is in use, the method comprising the steps of:

a. forming the fabric with one or more fiber materials wherein at least one of the one or more fiber materials has a liquid diverting trait and wherein the at least one of the fiber materials is positioned at the back side of the fabric; and b. physically modifying the one or more fiber materials to establish a network of interstices in the interior of the fabric sufficient to slow the progression of liquid from the interior out of the fabric through the front side thereof.

2. The method as claimed in claim 1 wherein the one or more fiber materials include a first fiber material and a second fiber material, wherein the second fiber material is the at least one of the one or more fiber materials.

3. The method as claimed in claim 1 wherein one of the one or more fiber materials is a hollow fiber material.

4. The method as claimed in claim 1 further comprising the step of adding an additive material to the fabric.

5. The method as claimed in claim 4 wherein the additive is a silver fiber.

6. The method as claimed in claim 1 further comprising the steps of:

a. pretreating at least the front side of the fabric; and b. dyeing or printing at least on the front side of the fabric.

7. The method as claimed in claim 1 further comprising the step of forming the back side of the fabric to be more porous than the front side of the fabric.

8. The method as claimed in claim 1 wherein the step of physically modifying the one or more fibers is achieved by knitting the one or more fibers together to establish the network of interstices.

9. The method as claimed in claim 1 wherein the step of physically modifying the one or more fibers is achieved by weaving the one or more fibers together to establish the network of interstices.

* * * * *

US008440119C1

(12) EX PARTE REEXAMINATION CERTIFICATE (24th)

Ex Parte Reexamination Ordered under 35 U.S.C. 257

United States Patent

Ackroyd et al.

(10) Number: US 8,440,119 C1

(45) Certificate Issued: Feb. 12, 2015

(54) PROCESS OF MAKING A FABRIC

(75) Inventors: Dennis D. Ackroyd, Casco, ME (US); Francis Lai, Richmond (CA)

(73) Assignee: Cool Comfort Technologies, Inc., Windham, ME (US)

Supplemental Examination Request:
No. 96/000,053, Mar. 21, 2014

Reexamination Request:
No. 90/013,214, Apr. 11, 2014
No. 90/013,233, May 16, 2014

Reexamination Certificate for:

| | |
|---|---|
| Patent No.: | **8,440,119** |
| Issued: | **May 14, 2013** |
| Appl. No.: | **12/334,682** |
| Filed: | **Dec. 15, 2008** |

Related U.S. Application Data

(60) Provisional application No. 61/014,973, filed on Dec. 19, 2007.

(51) Int. Cl.

| | |
|---|---|
| ***D03D 15/00*** | (2006.01) |
| ***D06C 23/00*** | (2006.01) |
| ***D04B 39/00*** | (2006.01) |
| ***D03D 23/00*** | (2006.01) |
| ***D03D 1/00*** | (2006.01) |
| ***D04B 9/00*** | (2006.01) |
| ***F28C 3/08*** | (2006.01) |

(52) U.S. Cl.

CPC ..... *D03D 15/00* (2013.01); *D03D 15/0077* (2013.01); *D03D 15/0094* (2013.01); *D03D 1/00* (2013.01); *D04B 9/00* (2013.01); *D03D 15/0083* (2013.01); *F28C 3/08* (2013.01); *D03D 15/0066* (2013.01); *D10B 2101/20* (2013.01); *D10B 2331/04* (2013.01); *D10B 2401/022* (2013.01); *D10B 2403/0114* (2013.01); *D10B 2509/026* (2013.01); *D10B 2331/02* (2013.01); *D10B 2401/021* (2013.01); *D10B 2401/14* (2013.01); *D10B 2501/00* (2013.01)

USPC ..... 264/78; 264/103; 264/129; 264/232

(58) Field of Classification Search

None

See application file for complete search history.

(56) References Cited

To view the complete listing of prior art documents cited during the supplemental examination proceeding and the resulting reexamination proceeding for Control Number 96/000,053, and during the proceedings for Reexamination Control Numbers 90/013,214 and 90/013,233, please refer to the USPTO's public Patent Application Information Retrieval (PAIR) system under the Display References tab.

*Primary Examiner* — Norca L Torres Velazquez

(57) ABSTRACT

A fabric for thermal management including the cooling of an object, such as a person's skin. The fabric is formed of a plurality of materials including at least one liquid transport enhancing material and at least one evaporative transport impeding material. When the fabric is in use, the transport enhancing material is located near an object to be cooled, while the evaporation impeding material is spaced away from the object. The fabric is peached so that there is an entanglement of the two materials. Peaching is performed on both sides of the fabric, but initially on the side with the transport enhancing material such that a portion of the evaporation impeding material is pulled into the fabric core. A method of making the fabric is also described.

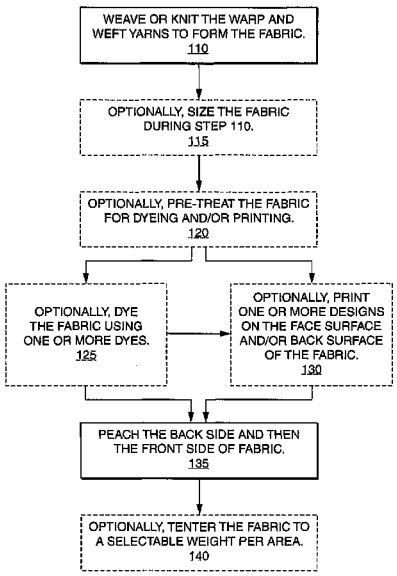

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 3, 8 and 9 are cancelled.

Claims 4, 5, 6 and 7 are determined to be patentable as amended.

New claims 10-15 are added and determined to be patentable.

4. The method as claimed in claim [1] *10*, further comprising the step of adding an additive material to the fabric.

5. The method as claimed in claim 4, wherein the additive *material* is a silver fiber.

6. The method as claimed in claim [1] *10*, further comprising the steps of:

a. pretreating at least the front side of the fabric; and b. dyeing or printing at least on the front side of the fabric.

7. The method as claimed in claim [1] *10*, further comprising the step of forming the back side of the fabric to be more porous than the front side of the fabric.

*10. A method of making a fabric having a front side, a back side and an interior between the front side and the back side, wherein the front side of fabric is the side adjacent to the environment when the fabric is in use and the back side is the side adjacent to an object to be cooled when the fabric is in use, the method comprising the steps of:*

*a. providing a first yarn material having a liquid diverting trait, and a second yarn material having a hydrophilic trait;*

*b. weaving or knitting together the first yarn material and the second yarn material to form a woven or knitted fabric such that the first yarn material is positioned at the back side of the fabric to wick a liquid away from the object to be cooled so as to provide an evaporative cooling effect to the object, and such that the second yarn material is positioned at the front side of the fabric to restrict evaporation of the liquid through the front side of the fabric; and*

*c. peaching the front and back sides of the fabric to pull fibers of the first yarn material and fibers of the second yarn material into the interior of the fabric in an entangled fashion so as to establish a network of tortuous pathways amongst the entangled fibers sufficient to slow the progression of liquid through the interior of the fabric and out through the front side of the fabric.*

*11. The method as claimed in claim 10, wherein the first yarn material is formed of fibers having a non-uniform cross section.*

*12. The method as claimed in claim 10, wherein the first yarn material is a polyester and the second yarn material is a nylon.*

*13. The method as claimed in claim 12, wherein the combination is about 80% polyester material and about 20% nylon material.*

*14. The method as claimed in claim 10, wherein the step of peaching the front and back sides of the fabric includes first peaching the back side of the fabric and then peaching the front side of the fabric.*

*15. The method as claimed in claim 10, further comprising the step of incorporating hollow fibers within the interior of the fabric.*

* * * * *